United States Patent [19]

Kaminski et al.

[11] Patent Number: 4,790,171

[45] Date of Patent: Dec. 13, 1988

[54] UPSTACKER REJECT APPARATUS

[75] Inventors: Elton G. Kaminski, Sidney; Richard J. Hasselbeck, Troy, both of Ohio

[73] Assignee: The Stolle Corporation, Sidney, Ohio

[21] Appl. No.: 79,244

[22] Filed: Jul. 29, 1987

[51] Int. Cl.[4] ..... B21D 22/00

[52] U.S. Cl. ..... 72/361; 72/427; 209/571; 414/96

[58] Field of Search ..... 72/427, 361; 414/96; 209/571, 653, 928

[56] References Cited

U.S. PATENT DOCUMENTS 1,920,762 8/1933 Neff ..... 414/96

4,203,314 5/1980 Vandlik et al. ..... 72/361

4,390,098 6/1983 Wilgus et al. ..... 414/96

*Primary Examiner*—W. Donald Bray

*Attorney, Agent, or Firm*—Frost & Jacobs

[57] ABSTRACT

An upstacker reject device includes a reciprocating plunger connected to a selectively oscillating shaft. A bellcrank is adjustably connected to a press ram and a rotatably mounted cylinder. A clutch is engaged to transfer rotary motion from the cylinder to the shaft. As the press ram travels downwardly, the cylinder and shaft are rotated, thereby causing the plunger to travel upwardly and engage an article carried by a transfer belt. A cylinder assembly and motion restriction cooperate with the clutch to insure that the plunger is retracted before the belt is advanced.

10 Claims, 4 Drawing Sheets

UPSTACKER REJECT APPARATUS

BACKGROUND OF THE INVENTION

1. Field of the Invention

The present invention relates to an apparatus for rejecting articles from a press conveyor to an upstacking device.

2.Description of the Related Art

Metallic closures for cans and the like are often formed in a rapid metal stamping operation. In general, closures are transported by a transfer belt to various stations for shell forming, tab forming, etc.

It is well-known in the art to transfer finished closures from the transfer belt at an upstacking station. The transfer belt is stopped and a reciprocating member moves upward through an aperture in the belt and pushes the closure upward into the upstacking station. The reciprocating member then moves downwardly to a position below the transfer belt and the belt is advanced forward for the next operation.

U.S. Pat. No. 4,390,098 issued to Wilgus et al. discloses an apparatus for automatically rejecting closures from an upstacking device. A variable length reciprocating member selectively pushes closures from a transfer belt into a closure receiving means. The reciprocating member is a double acting pneumatic cylinder by a lever and pivot arrangement. In the reject mode, the variable length member is retracted so that it does not contact a closure. All rejected closures continue to travel along the conveyor and fall into a bin.

Particularly at high speed operations, prior art reciprocating members have a tendency of catching and hanging onto the transfer belt. If a reciprocating member fails to retract below the belt, the member will remain in the belt aperture, resulting in belt tearing as the belt is advanced.

In high speed presses, a short press stroke is employed. This stroke is usually in the range of $1\frac{1}{2}''$ to 2". This short stroke does not provide sufficient space, when the press ram is fully retracted, to gain access to the tooling for maintenance purposes. To offset this disadvantage, press manufacturers incorporate a hydraulic or mechanical system to allow raising the ram an additional two or three inches to provide tooling access.

In conventional upstacker/reject systems, such as disclosed in U.S. Pat. No. 4,390,098, the attachment to the ram must be disconnected before the ram is raised for tooling maintenance. If it is not disconnected, damage to the upstacker/reject system occurs since it is designed for movement within the confines of the press stroke only.

Consequently, a need exists in improvements in upstacker rejecting devices for conventional presses. It is desirable that upstacker reject devices provide dependable operation in high-speed operations. Furthermore, it is desirable that such a reject device include means to insure that the reciprocating member is retracted below the transfer belt before the belt is advanced. Also, an improved upstacker should permit automatic disengagement when the ram is retracted to gain access to the tooling for maintenance.

SUMMARY OF THE INVENTION

The present invention includes an upstacker reject apparatus for use with a conventional press. The reject apparatus includes a reciprocating plunger for pushing articles from a transfer belt into a receiving station. The apparatus includes a cylinder assembly to insure that the plunger has been retracted below the transfer belt before the belt has been advanced. The present invention automatically disconnects the upstacker from the ram to permit additional retraction of the ram for maintenance. The present apparatus is reliable, economical, and easy to operate and maintain.

In a preferred embodiment, the present invention includes an upstacker reject device having a reciprocating plunger connected to a selectively oscillating shaft. A bellcrank is adjustably connected to a press ram and a rotatably mounted cylinder. A clutch is engaged to transfer rotary motion from the cylinder to the shaft. As the press ram travels downwardly, the cylinder and shaft are rotated, thereby causing the plunger to travel upwardly and engage an article carried by a transfer belt. A cylinder assembly and motion restriction cooperate with the clutch to insure that the plunger is retracted before the belt is advanced.

DETAILED DESCRIPTION OF THE PREFERRED EMBODIMENT

Figure 1:
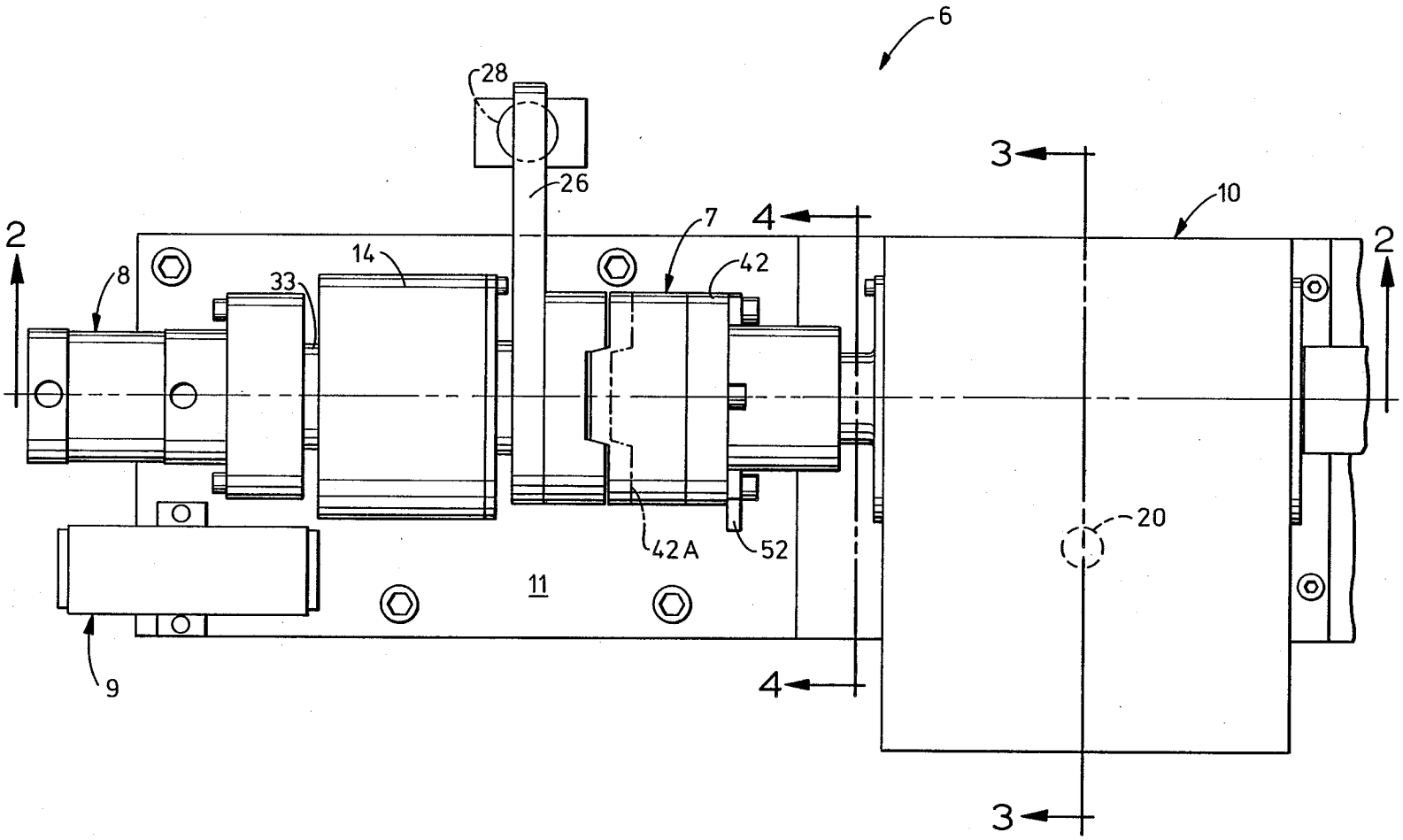
FIG. 1 is a top plan view of a preferred embodiment of the upstacker reject apparatus of the present invention.

A preferred embodiment of the present upstacker reject apparatus, indicated generally at 6, is illustrated in FIG. 1. The apparatus 6 includes a reject station 10, a clutch assembly 7, a bellcrank 26, a first cylinder assembly 8, a support bearing 14 and a valve assembly 9, all of which are supported by a base 11.

Figure 2:
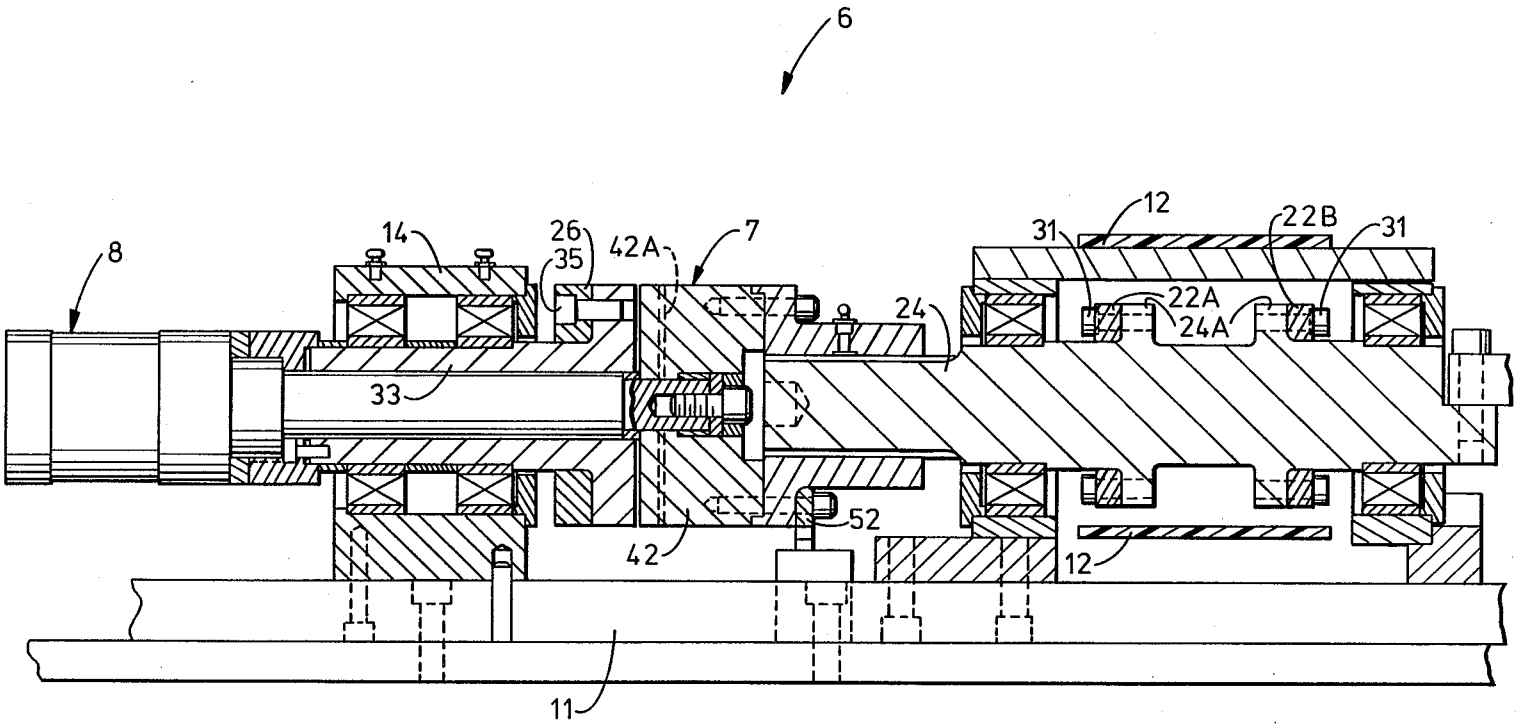
FIG. 2 is a sectional view taken along line 2—2 of FIG. 1.
Figure 3:
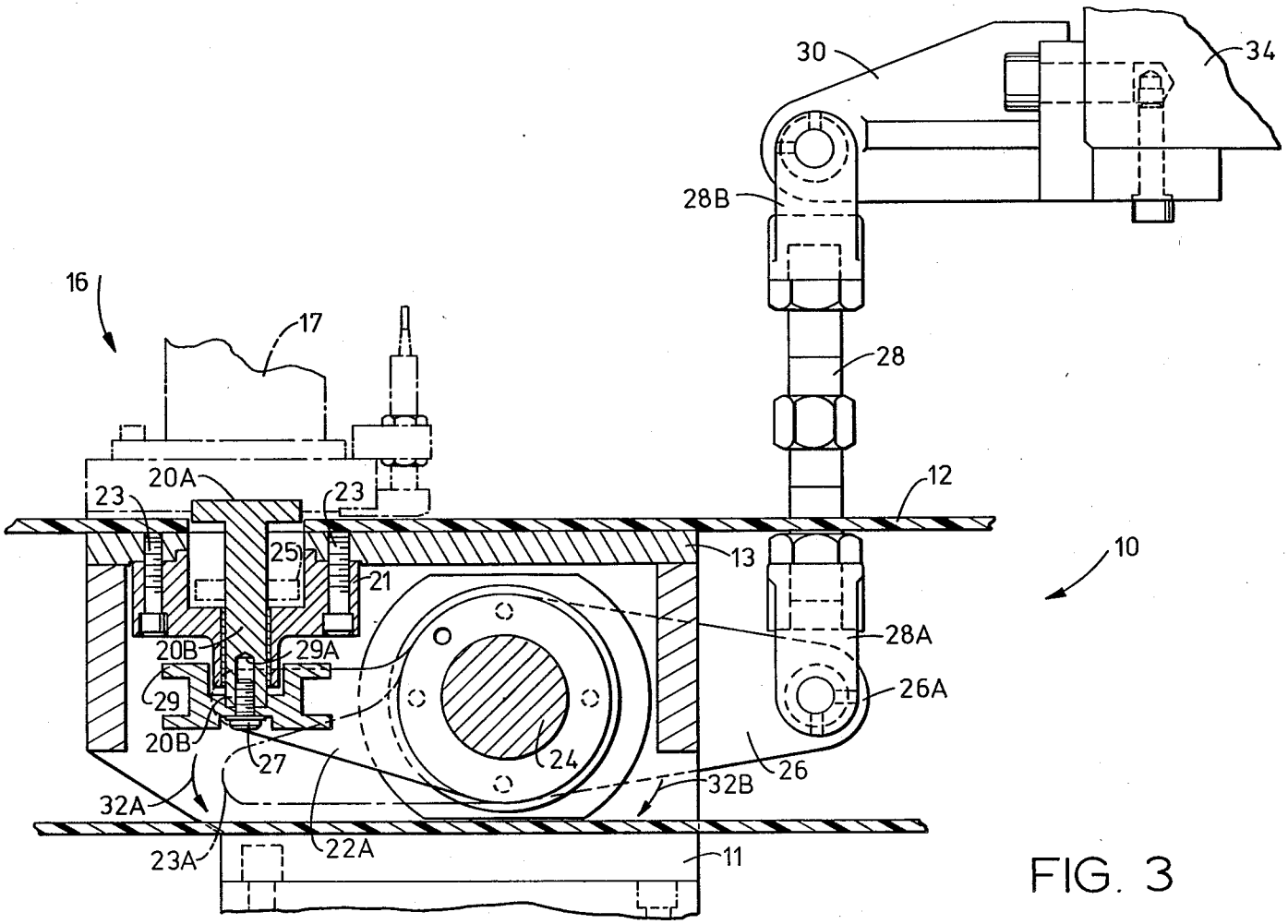
FIG. 3 is a sectional view taken along line 3—3 of FIG. 1.

The reject station 10 of the present apparatus 6 is illustrated in detail in FIGS. 2 and 3. An article transfer belt 12 supported by frame 13 and base 11 carries selected articles such as closures (not illustrated) along a conventional press. The transfer belt 12 includes a plurality of apertures. Closures are deposited on the belt 12 so that each closure covers an aperture. The transfer belt 12 passes beneath an upstacking station 16 having a closure receiving apparatus 17 for receiving closures.

The reject apparatus 10 includes a reciprocating plunger 20. The plunger 20 includes an upper planar surface 20A for extending through belt apertures and engaging closures. A lower stem 20B of plunger 20 is connected to yokes 22A and 22B (yoke 22B is illustrated only in FIG. 2). In other embodiments of the reject apparatus 6, a plurality of yokes can be connected to a plurality of plungers. For example, in a two-lane conversion press, two rows of closures can be transported to the upstacking station 16. Two plungers, each connected to and actuated by a yoke as described below, can be provided to push closures upwardly into the closure receiving apparatus 17.

Plunger stem 20B is received in guide 21, which is secured to frame 13 by fasteners 23. In FIG. 3, the plunger 20 is illustrated in the "up" position, wherein plunger surface 20A extends through an aperture in belt 12 to force a closure (not illustrated) into the closure receiving apparatus 17. Phantom line 25 represents the position of the plunger surface 20A in the "down" position, as described below.

Yokes 22A and 22B are secured to an oscillatory shaft 24 at a first end to annular flanges 24A of an oscillatory shaft 24 by fasteners 31 (see FIG. 2). At a second end, yokes 22A and 22B are secured to plunger 20 by fasteners 27 and bracket 29. Fastener 27 is inserted through an opening in bracket 29 and threaded into a complimentary dwell 29A in plunger stem 20B. In FIG. 3 yoke 22A is illustrated in the "up" position. Phantom line 23A represents the position of yoke 22A in the "down" position. Yokes 22A and 22B are secured to annular flanges 24A of shaft 24 by fasteners 31 (see FIG. 2).

As illustrated in FIG. 2, bellcrank 26 is secured at a first end to a cylinder 33 of cylinder assembly 8 by fasteners 35. A bearing 14, mounted on the base 11, supports cylinder 33. As illustrated in FIG. 3, a portion 26A of bellcrank 26 is pivotally connected to a lower end 28A of an adjustable link 28. The upper end 28B of the adjustable link 28 is pivotally connected to a bracket 30 associated with a conventional press ram 34 (partially illustrated). Link 28 can be extended or shortened as necessary to accommodate the distance between bellcrank 26 and bracket 30.

The clutch assembly 7 is provided between cylinder 33 and shaft 24. The clutch assembly 7 includes a single point clutch 42 and a motion restricting plate 52. Cylinder 33 is actuated by cylinder assembly 8. When the cylinder 33 is extended, the clutch 42 is engaged.

When the clutch 42 is engaged, the reciprocating motion of the press ram is transferred through bracket 30, adjustable link 28, bellcrank 26, shaft 24 and yokes 22A and 22B to actuate plunger 20. As the press ram 34 moves upwardly during its up stroke, bracket 30, adjustable link 28 and bellcrank portion 26A are pulled upwardly. Shaft 24 is forced to rotate in a counterclockwise direction indicated by arrow 32A. Yokes 22A and 22B are forced downwardly, thereby causing plunger 20 to withdraw from a belt opening and not engage a closure of the transfer belt 12.

This cycle is reversed during the down stroke of the press ram 34. Bracket 30, adjustable link 28 and bellcrank portion 26A are forced downwardly, thereby rotating shaft 24 in a clockwise direction indicated by arrow 32B. Yokes 22A are forced upwardly, causing plunger 20 to move upwardly and engage closures on the transfer belt 12.

It is understood that a plurality of plungers 20 can be incorporated in the present apparatus 6. Each plunger 20 would be actuated by respective yokes 22 in the manner described above to reject closures from the belt.

While it is understood that cylinder 33 can be actuated by any conventional means, a pneumatic cylinder is preferred. In a preferred embodiment, valve assembly 9 controls cylinder 33. It is preferred that valve assembly 9 be mounted in close proximity to cylinder 33 to shorten the length of air lines, thereby minimizing delays in the cylinder 33.

When the clutch 42 is disengaged, represented by phantom line 42A in FIGS. 1 and 2, shaft 24 does not oscillate with cylinder 33, thereby preventing the transfer of reciprocating motion to the press ram through the bellcrank 26 to shaft 24. Therefore, plunger 20 is not actuated, and closures are not forced into the closure receiving apparatus 17.

Figure 4:
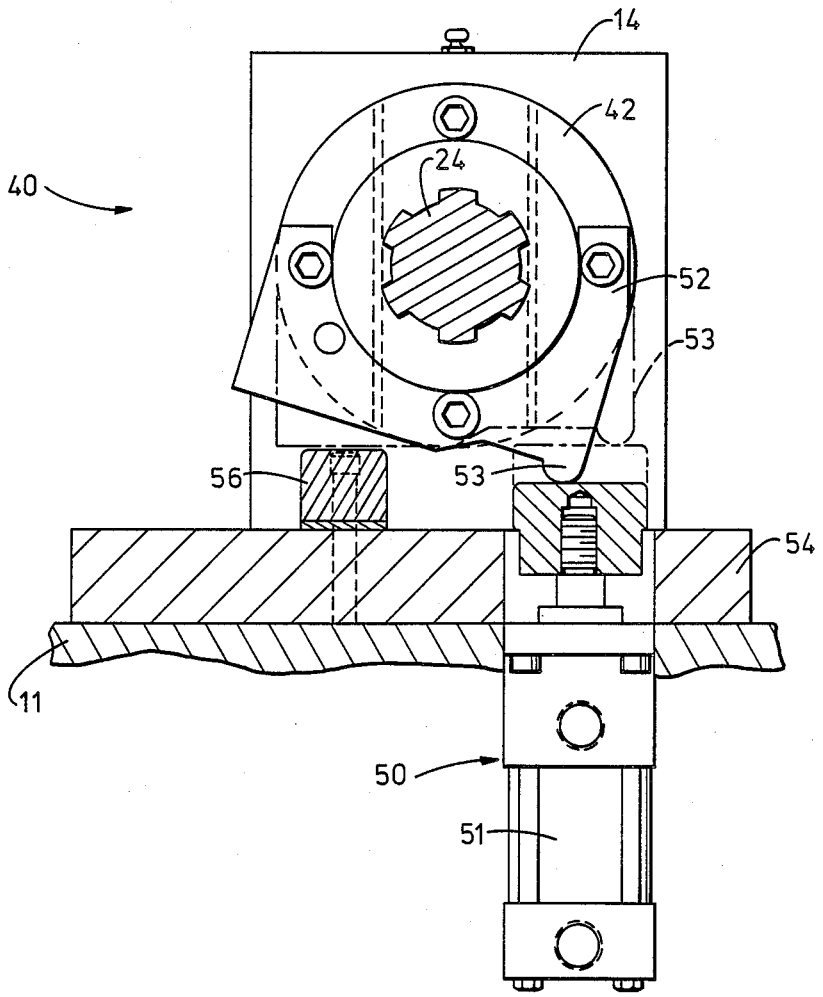
FIG. 4 is a sectional view taken along line 4—4 of FIG. 1.

A second cylinder assembly 50, illustrated only in FIG. 4, cooperates with the reject apparatus 6 to prevent accidental rejections by plunger 20. The second cylinder assembly 50 includes a retractable cylinder 51. When the cylinder 51 is retracted, oscillation of shaft 24 is permitted. A motion restricting plate 52 having flange 53 is rotatably mounted on the clutch 42. As the cylinder 51 is extended, a plunger 54 engages flange 53 to rotate shaft 24. A stop 56 is provided on the press 12 to restrict the rotation of shaft 24 when the clutch 42 is disengaged.

As cylinder 24 is actuated to reject articles from transfer belt 12, cylinder 51 is simultaneously actuated to drive the plunger 54 upwardly. The upstacker shaft 24 now locked between the plunger 54 and stop 56. In this position, the plunger 54 is retracted from the-transfer belt 12.

When the clutch 42 is disengaged, the bellcrank 26 can be pivoted about shaft 33 without interference to the plunger 20 or reject station 10. The press ram can be raised an additional height for tooling maintenance without manual disconnection of the plunger 20 or reject station 10.

Although the present invention has been described with reference to preferred embodiments, workers skilled in the art will recognize that changes may be made in form and detail without departing from the spirit and scope of the invention.

What is claimed is:

1. An upstacker reject device for use with a press ram, comprising:

(a) a shaft capable of oscillatory motion, supported by a base, said shaft having a longitudinal axis;

(b) at least one plunger capable of reciprocating motion;

(c) means for connecting the plunger to the shaft, said plunger connecting means comprising at least one yoke pivotally connected at a first end to the plunger and secured at a second end to the shaft;

(d) means for connecting the shaft to the press ram, said shaft connecting means comprising:

(1) a cylinder, having a longitudinal axis, rotatably mounted on the base, the longitudinal axis of the cylinder being substantially co-linear with the longitudinal axis of the shaft;

(2) a bellcrank secured at a first end to the cylinder;

(3) means for connecting the cylinder to the shaft so that rotary motion in the cylinder is transferred to the shaft; and (4) linkage means for connecting the bellcrank to the press ram;

(e) a transfer belt, having apertures, for carrying selected articles, whereby the downward stroke of the press ram causes the plunger to move upwardly through a belt aperture to reject an article on the belt.

2. The upstacker reject device as specified in claim 1, wherein the means for connecting the cylinder to the shaft comprises a single point clutch.

3. The upstacker reject device as specified in claim 2 including a cylinder assembly for selectively reciprocating the cylinder for engagement and disengagement of the clutch.

4. The upstacker reject device as specified in claim 1, wherein the linkage means for connecting the bellcrank to the press ram comprises an adjustable link pivotally connected at a first end to a second end of the bellcrank and a second and pivotally connected to the press ram.

5. The upstacker reject device as specified in claim 1 including means to insure that the plunger is retracted below the belt.

6. The upstacker reject device as specified in claim 2 including means to insure that the plunger is retracted below the belt.

7. The upstacker reject device as specified in claim 6 wherein the means to insure that the plunger is retracted comprises:

(a) a motion restriction plate mounted on the clutch;

(b) a second cylinder assembly having an extendable plunger which is extended to rotate the shaft and permit rejections of articles on the belt.

8. The upstacker reject device as specified in claim 7 including a stop mounted on the base to prevent over-rotation of the motion restricting plate when the clutch is disengaged.

9. The upstacker reject device as specified in claim 1 including means for receiving rejected articles from the belt.

10. The upstacker reject device as specified in claim 2 wherein the press ram is freely movable to permit additional retraction when the single point clutch is disengaged.

* * * * *